US007155918B1

(12) United States Patent
Shivers, III

(10) Patent No.: US 7,155,918 B1
(45) Date of Patent: Jan. 2, 2007

(54) SYSTEM FOR PROCESSING AND TRANSPORTING COMPRESSED NATURAL GAS

(75) Inventor: Robert Magee Shivers, III, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 407 days.

(21) Appl. No.: 10/861,969

(22) Filed: Jun. 4, 2004

Related U.S. Application Data

(60) Provisional application No. 60/485,984, filed on Jul. 10, 2003.

(51) Int. Cl.

| | |
|---|---|
| ***F17C 13/08*** | (2006.01) |
| ***F17C 3/08*** | (2006.01) |
| ***F17C 7/02*** | (2006.01) |
| ***F25J 3/00*** | (2006.01) |

(52) U.S. Cl. ..... 62/53.2; 62/618; 62/45.1; 62/50.1

(58) Field of Classification Search ..... 62/45.1, 62/50.1, 53.2, 618, 619
See application file for complete search history.

(56) References Cited

U.S. PATENT DOCUMENTS

| | | | | |
|---|---|---|---|---|
| 2,937,140 | A * | 5/1960 | Stinson | 208/340 |
| 3,232,725 | A | 2/1966 | Secord et al. | 48/190 |
| 3,242,681 | A * | 3/1966 | Shaievitz | 62/614 |
| 4,505,127 | A * | 3/1985 | Pronovost et al. | 62/271 |
| 6,016,667 | A * | 1/2000 | Doerler et al. | 62/625 |
| 6,089,028 | A | 7/2000 | Bowen et al. | 62/50.2 |
| 6,094,937 | A * | 8/2000 | Paurola et al. | 62/613 |
| 6,209,350 | B1 * | 4/2001 | Kimble, III | 62/613 |
| 6,237,347 | B1 | 5/2001 | Rigby et al. | 62/41.8 |
| 6,378,330 | B1 | 4/2002 | Minta et al. | 62/613 |
| 6,460,721 | B1 | 10/2002 | Bowen et al. | 220/583 |
| 2003/0159581 | A1 * | 8/2003 | Sanderford et al. | 95/243 |
| 2005/0077235 | A1 * | 4/2005 | Rhodes | 210/521 |

FOREIGN PATENT DOCUMENTS

| | | |
|---|---|---|
| WO | WO/98/59085 | 6/1998 |
| WO | WO/99/32837 | 6/1998 |
| WO | WO/00/23756 | 10/1999 |
| WO | WO/00/36332 | 12/1999 |
| WO | WO/00/57102 | 2/2000 |
| WO | WO/01/92778 | 5/2001 |

OTHER PUBLICATIONS

Bennett, C.P. "M-3 Marine Transportation of LNG at Intermediate Temperature". pp. 751-756.

(Continued)

*Primary Examiner*—William C. Doerrler
(74) *Attorney, Agent, or Firm*—Wendy K. Buskop; Buskop Law Group PC

(57) ABSTRACT

A system for processing and transporting compressed natural gas having a separator for separating the pressurized high-energy content gas into saturated gas and liquids; a decontamination unit for removing impurities from the saturated gas to create a decontaminated saturated gas; a dehydration unit for dehydrating the decontaminated saturated gas to remove water forming a dry pressurized gas; a chiller for cooling the dry pressurized gas cooled from ambient temperature to between −80 Fahrenheit and −120 Fahrenheit forming a two-phase gas; a floating vessel; at least one storage module located on the floating vessel that maintains a pressure ranging from 800 psi and 1200 psi; and wherein the floating vessel transports at least one storage module a distance ranging between 500 nautical miles and 2500 nautical miles and utilizes the vapor phase during transit to power the floating vessel.

22 Claims, 3 Drawing Sheets

OTHER PUBLICATIONS

Broeker, Roger J. *American Gas Journal*. "CNG and MLG—New Natural Gas Transportation". *American Gas Journal*, Jul., 1969.

Faridany, Edward K.M., Roger C. Ffooks, and Robin B. Meikle. "A Pressure LNG System". European Offshore Petroleum conference and Exhibition, pp. 245-254.

Faridany E.K., et al. "The Ocean Phoenix Pressure—LNG System," pp. 267-280.

Fluggen E. and Dr. Ing. H. Backhaus. "Pressurised LNG—and the Utilisation of Small Gas Fields," pp. 195-204.

* cited by examiner

FIGURE 2
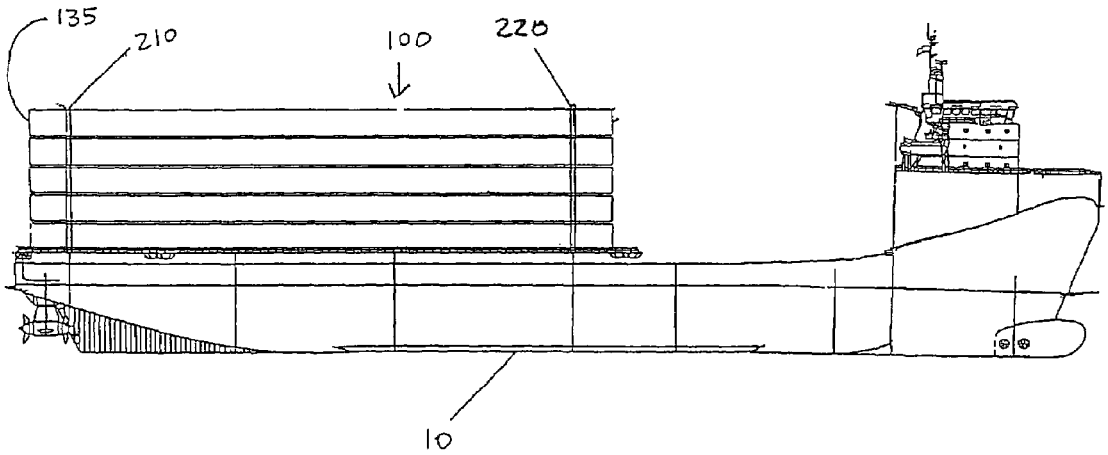
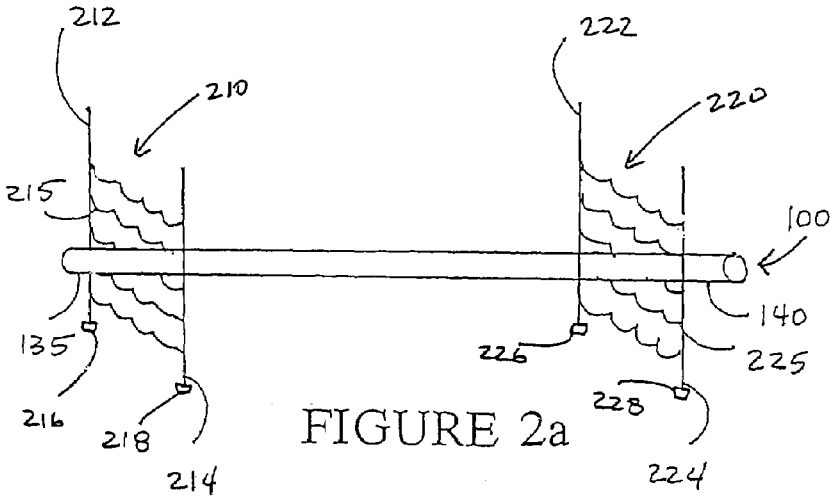
FIGURE 2a

SYSTEM FOR PROCESSING AND TRANSPORTING COMPRESSED NATURAL GAS

The present application claims priority to U.S. Provisional Patent Application Ser. No. 60/485,984 filed on Jul. 10, 2003 now abandoned.

FIELD

The present embodiments relate to a system for processing and transporting compressed natural gas.

BACKGROUND

The current art teaches three known methods of transporting natural gas across bodies of water. A first method is by way of subsea pipeline. A second method is by way of ship transport as liquefied natural gas (LNG). A third method is by way of barge, or above deck on a ship, as compressed natural gas (CNG). Each method has inherent advantages and disadvantages.

Subsea pipeline technology is well known for water depths of less than 1000 feet. The cost of deep water subsea pipelines is very high and methods of repairing and maintaining deep water subsea pipelines are just being pioneered. Transport by subsea pipeline is often not a viable option when crossing bodies of water exceeding 1000 feet in depth. A further disadvantage of subsea pipelines is that, once laid, it is impractical to relocate.

Liquefied natural gas systems, or LNG systems, require natural gas to be liquefied. This process greatly increases the fuel's density, thereby allowing relatively few numbers of ships to transport large volumes of natural gas over long distances. An LNG system requires a large investment for liquefaction facilities at the shipping point and for regasification facilities at the delivery point. In many cases, the capital cost of constructing LNG facilities is too high to make LNG a viable option. In other instances, the political risk at the delivery and/or supply point may make expensive LNG facilities unacceptable. A further disadvantage of LNG is that even on short routes, where only one or two LNG ships are required, and the transportation economics are still burdened by the high cost of full shore facilities. The shortcoming of a LNG transport system is the high cost of the shore facilities that, on short distance routes, becomes an overwhelming portion of the capital cost.

Natural gas prices are currently increasing rapidly due to an inability to meet demand. Unfortunately, the LNG import terminals existing in the United States are presently operating at capacity. New import terminals of the type currently used in the United States cost hundreds of millions of dollars to build. Moreover, it is very difficult and expensive to find and acquire permissible sites for such facilities. Besides the space needed for the import tanks, pumps, vaporizers, etc., large impoundment safety areas must also be provided around all above-ground LNG storage and handling vessels and equipment. LNG import facilities also consume large amounts of fuel gas and/or electrical energy for pumping the LNG from storage and vaporizing the material for delivery to gas distribution systems.

Compressed natural gas, or CNG, can be transported by way of barge or above deck on a ship. For the method to work, the CNG is cooled to a temperature around −75 degrees Fahrenheit at a pressure of around 1150 psi. The CNG is placed into pressure vessels contained within an insulated cargo hold of a ship. Cargo refrigeration facilities are not usually provided aboard the ship. A disadvantage of this system is the requirement for connecting and disconnecting the barges into the shuttles that takes time and reduces efficiency. Further disadvantages include the limited seaworthiness of the multi-barge shuttles and the complicated mating systems that adversely affect reliability and increase costs. In addition, barge systems are unreliable in heavy seas. Finally, current CNG systems have the problem of dealing with the inevitable expansion of gas in a safe manner as the gas warms during transport.

The amount of equipment and the complexity of the inter-connection of the manifolding and valving system in the barge gas transportation system bears a direct relation to the number of individual cylinders carried onboard the barge. Accordingly, a significant expense is associated with the manifolding and valving connecting the gas cylinders. Thus, the need has arisen to find a storage system for compressed gas that can both contain larger quantities of compressed gas and simplify the system of complex manifolds and valves.

A need exists to transfer compressed natural gas across heavy seas to locations greater than 500 nautical miles.

A need exists for a system that can solve the concerns of the inevitable expansion of gas experienced as CNG warms during transport.

SUMMARY

A system for processing and transporting compressed natural gas includes a separator for separating the pressurized high-energy content gas into saturated gas, natural gas liquid, and a condensate. The system includes a decontamination unit for removing impurities from the saturated gas to create a decontaminated saturated gas and a dehydration unit for dehydrating the decontaminated saturated gas to remove water forming a dry pressurized gas. The system has a chiller for cooling the dry pressurized gas cooled from ambient temperature to a temperature ranging from −80 degrees Fahrenheit to −120 degrees Fahrenheit. The system has one or more storage modules located on a floating vessel for receiving the vapor gas, the natural gas liquid, and the condensate. The modules maintain a pressure ranging from about 800 psi and about 1200 psi. The floating vessel transports the storage modules a distance ranging from 500 nautical miles to 2500 nautical miles and utilizes the vapor phase during transit to power the floating vessel.

BRIEF DESCRIPTION OF THE DRAWINGS

The present embodiments will be explained in greater detail with reference to the appended Figures, in which:

FIG. 2 depicts a side view of the storage module located on a floating vessel.

FIG. 2*a* depicts a perspective view of one rack and two stanchions of the storage module.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments herein and it can be practiced or carried out in various ways.

Embodied herein is a system for processing and transporting compressed natural gas.

Figure 1:
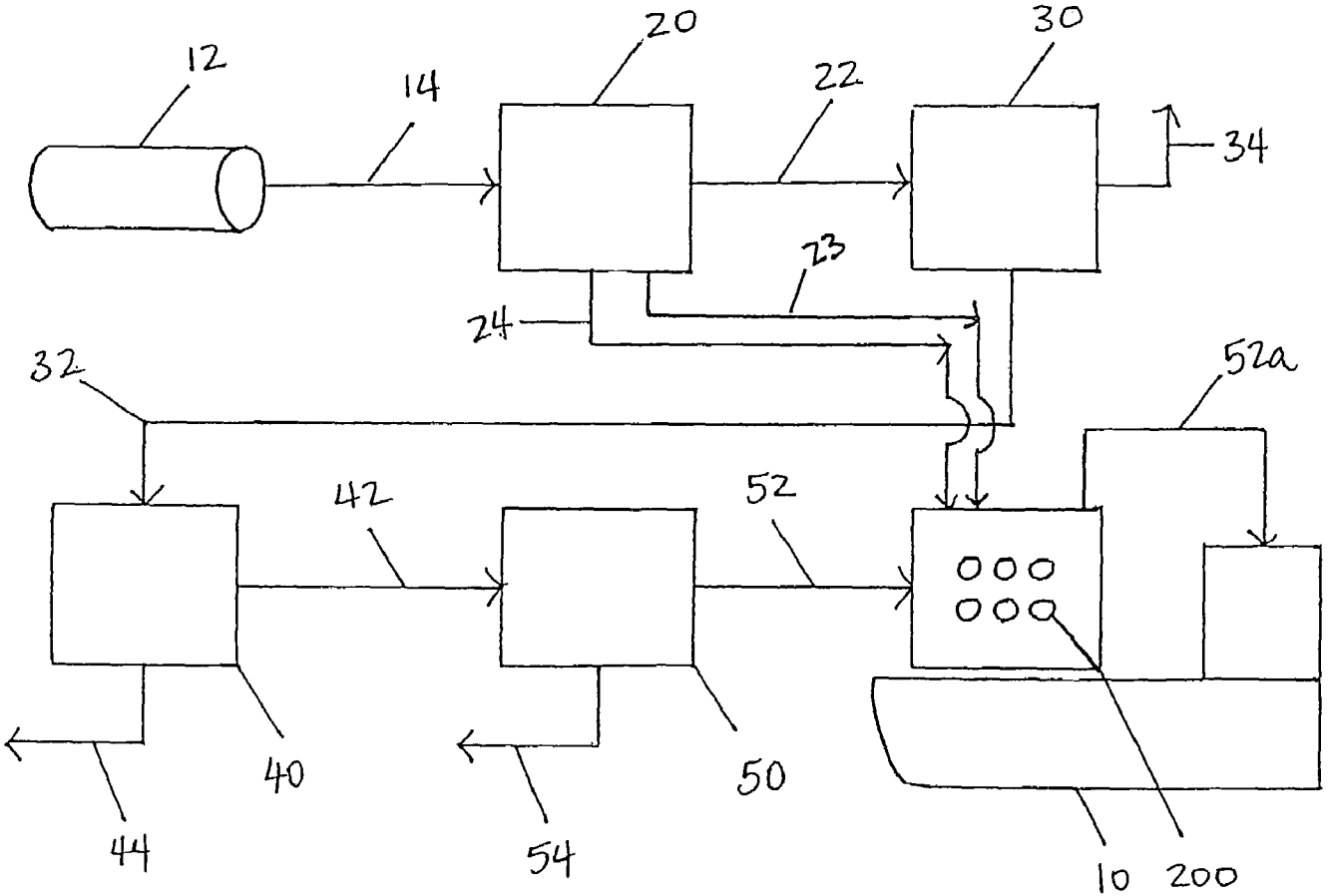
FIG. 1 is a schematic of an embodiment for a system for processing and transporting compressed natural gas system.

With reference to the figures, FIG. 1 depicts an embodiment of the system that includes a separator (20) for receiving pressurized high-energy content gas (14) from a pipeline (12). The separator separates the pressurized high-energy content gas (14) stream into saturated gas (22), natural gas liquid (23), and condensate (24). An example of a separator is a three-phase separation vessel.

The system involves a decontamination unit (30) connected to the separator (20) for receiving the saturated gas (22). The decontamination unit (30) removes impurities (34) from the saturated gas (22) to form decontaminated saturated gas (32). The types of impurities removed from the saturated gas (22) are CO2, mercury, H2S, and combinations thereof. Examples of decontamination units include an amine contactor, a catalytic bed, a scrubber vessel, or combinations thereof.

As shown in FIG. 1, the system includes a dehydration unit (40). The dehydration unit (40) is connected to the decontamination unit (30) and receives the decontaminated saturated gas (32). The dehydration unit (40) removes the water (44), in the form of water vapor, to create dry pressurized gas (42). Examples of dehydration units (40) usable in the system include dry bed adsorption units, glycol contact towers, molecular membrane units, or combinations thereof.

The system then includes a chiller (50) connected to the dehydration unit (40). The chiller receives the dry pressurized gas (42) and cools the dry pressurized gas (42) from ambient temperature to a temperature ranging from −80 degrees Fahrenheit to −120 degrees Fahrenheit forming a two-phase gas having a vapor phase (52) and a liquid phase (54). Examples of chillers (50) are a single-stage mixed refrigerant process and a two-stage cascade system. The chiller (50) is also used to sub-cool the dry pressurized gas (42) to delay the formation of the vapor phase (52).

Continuing in FIG. 1, the system uses at least one storage module (200) located on the floating vessel (10). The storage module (200) is connected to the chiller (50) and the separator (20) and receives the vapor phase (52) of the two-phase gas, the natural gas liquid (23), and the condensate (24). The storage module (200) maintains the vapor phase (52) of the two-phase gas, the natural gas liquid, and the condensate at a pressure ranging from 800 psi and 1200 psi.

The system finally includes a floating vessel (10). The floating vessel (10) is adapted to transport the at least one storage module (200) at a distance of ranging from 500 nautical miles to 2500 nautical miles. The vapor phase (52*a*) that is formed due to the warming of the two phase gas during transport is used to power the floating vessel (10). Using the vapor phase from the two-phase gas to power the floating vessel both alleviates the environmental concerns of the gas being vented to the atmosphere and also lowers the cost.

As shown in FIG. 2 and FIG. 2*a*, the storage module is made of a first structural frame (210) with two stanchions (212 and 214) and a second structural frame (220) with two stanchions (222 and 224). Each stanchion has a skid shoe (216, 218, 226, and 228). The skid shoe mountings allow the module to be transported from land to a floating vessel (10) easily. A first rack (215) connects the first and second stanchions (210 and 211). A second rack (225) connects the third and fourth stanchions (212 and 213).

Figure 3A:
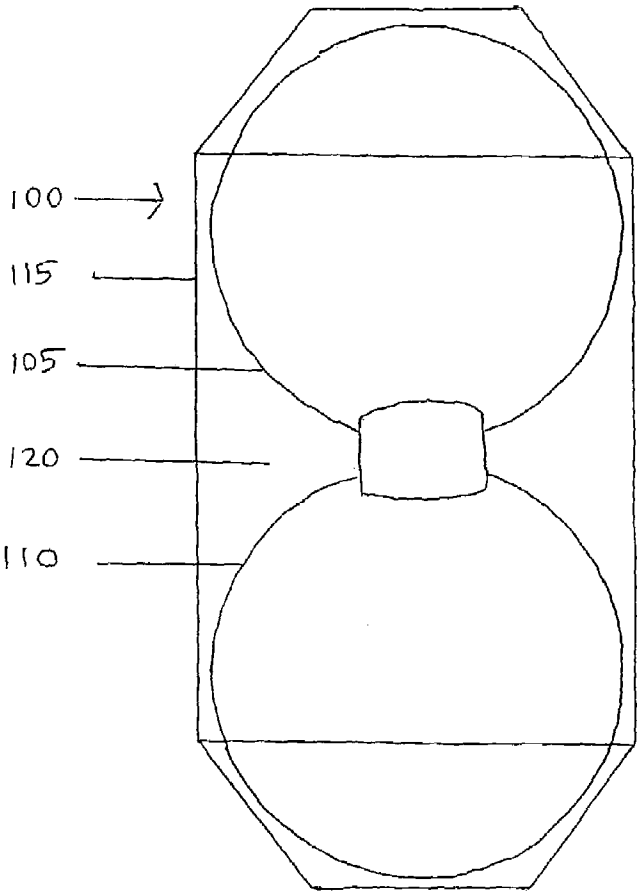
FIG. 3*a* depicts the spherical shape embodiment of the storage element.
Figure 3:
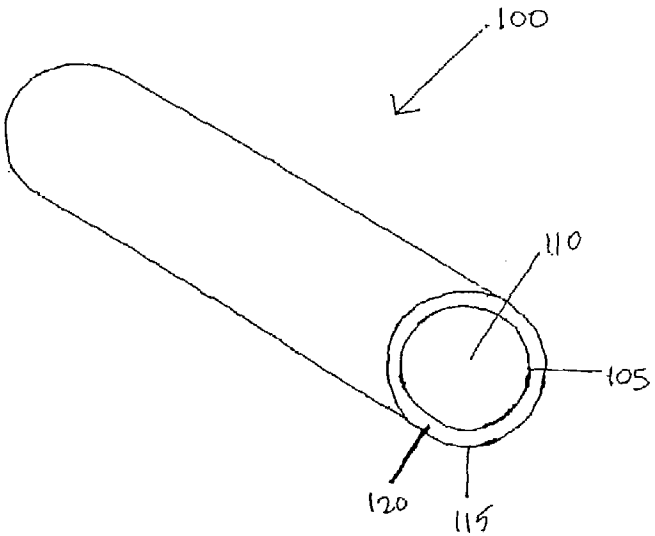
FIG. 3 depicts the cylindrical shape embodiment of the storage element.

Each storage module holds one or more storage elements (100). The storage elements have a first end (135) and a second end (140). An individual storage element (100) is shown in FIG. 3. The storage element (100) has an inner wall (105) forming a cavity (110), an outer wall (115), and an insulation layer (120) located between the inner wall (105) and outer wall (115). The cavity (110) is designed to hold compressed cooled natural gas, natural gas liquid, and condensate.

Returning to FIG. 2 and FIG. 2*a*, the first end (135) of the storage element is supported in the first rack (215) and the second end (140) is supported in the second rack (225).

The storage module supports between three and fifteen storage elements. The weight of the storage module when loaded with at least one empty storage element ranges from 5000 short tons to 8000 short tons.

The structural frames (210 and 220) can support up to five racks between the stanchions. The structural frames (210 and 220) can be located on a floating vessel (10) with a hull wherein the structural frames (210 and 220) extend beyond the hull and are supportable on at least two jetties.

The first and second racks can support up to five storage elements. The rack can further include a plate supported by a plurality of ridges for removably holding the storage element. The rack has an anchor for fixing the storage element at the first end. The second end, or unanchored end, is adapted to travel to accommodate thermal strain.

The storage element's empty weight ranges from 350 short tons to 700 short tons when loaded. Each storage element can have a length up to about 350 feet.

Returning to FIG. 3, the storage elements have an outer wall (115) thinner than the inner wall (105), since the outer wall (115) is not designed to be load bearing. The outer wall (115) can be steel, stainless steel, aluminum, thermoplastic, fiberglass, or combinations thereof. Stainless steel is preferred since stainless steel reduces radiant heat transfer and is fire-resistant and corrosion-resistant.

The construction material for the inner wall (105) is a high-strength steel alloy, such as a nickel-steel alloy. The construction material for the inner wall could be a basalt-based fiber pipe.

The shape of the storage element can either be cylindrical or spherical. The cylindrical shape, as shown in FIG. 3, is the preferred embodiment. The inner wall (105) has a diameter ranging from 8 feet to 15 feet with a preferred range from 10 feet to 12 feet. The outer wall (115) has a diameter that is up to four feet larger in diameter than the inner wall. FIG. 3*a* depicts the spherical embodiment of the storage element.

For the spherical shape, the inner wall has a diameter ranging from 30 feet to 40 feet. The outer wall has a diameter that is up to three feet larger in diameter than the inner wall.

The insulating layer is either perlite or a vacuum.

While these embodiments have been described with emphasis on the preferred embodiments, it should be understood that within the scope of the appended claims the embodiments might be practiced or carried out in various ways other than as specifically described herein.

What is claimed is:

1. A system for processing and transporting compressed natural gas comprising:

a. a separator for receiving pressurized high-energy content gas from a pipeline, wherein the separator separates the pressurized high-energy content gas into saturated gas, a natural gas liquid, and a condensate;

b. a decontamination unit connected to the separator for receiving the saturated gas, wherein the decontamination unit removes impurities from the saturated gas to create a decontaminated saturated gas;

c. a dehydration unit connected to the decontamination unit for receiving the decontaminated saturated gas, wherein the dehydration unit removes water from the decontaminated saturated gas forming a dry pressurized gas;

d. a chiller connected to the dehydration unit for receiving the dry pressurized gas, wherein the chiller cools the dry pressurized gas from ambient temperature to a temperature ranging from −80 degrees Fahrenheit to −120 degrees Fahrenheit forming a two-phase gas comprising a vapor phase and a liquid phase;

e. at least one storage element located on a floating vessel, wherein the storage element is connected to the chiller and the separator, wherein the storage element receives the two-phase gas, the natural gas liquid, and the condensate, wherein the storage element maintains the two-phase gas, the natural gas liquid, and the condensate at a pressure ranging from 800 psi and 1200 psi, wherein the storage element comprises:

i. an inner wall forming a cavity;

ii. an outer wall; and iii. an insulation layer disposed between the inner and outer wall, and wherein the cavity is adapted to hold the two-phase gas, the natural gas liquid, and the condensate;

f. the floating vessel adapted to transport the storage element a distance ranging from 500 nautical miles to 2500 nautical miles, and wherein the floating vessel utilizes the vapor phase during transit to power the floating vessel.

2. The system of claim 1, wherein the separator is a three-phase separation vessel.

3. The method of claim 1, wherein the impurities are a member of the group consisting of carbon dioxide, mercury, hydrogen sulfide, and combinations thereof.

4. The system of claim 1, wherein the decontamination unit is an amine contactor, a catalytic bed, a scrubber vessel, or combinations thereof.

5. The system of claim 1, wherein the dehydration unit is a dry bed adsorption unit, a glycol contact tower, a molecular membrane unit, or combinations thereof.

6. The system of claim 1, wherein the chiller is a single-stage mixed refrigerant process or a two-stage cascade system.

7. The system of claim 1, wherein the chiller is used to sub-cool the dry pressurized gas to delay the formation of the vapor phase.

8. The method of claim 1, wherein the outer wall is thinner than the inner wall.

9. The method of claim 1, wherein the inner wall is a high-strength steel alloy or a basalt-based fiber pipe.

10. The method of claim 9, wherein the high-strength steel alloy is a nickel-steel alloy.

11. The method of claim 1, wherein the outer wall is steel, stainless steel, an aluminum, a thermoplastic, a fiberglass, or combinations thereof.

12. The system of claim 1, wherein the storage element is cylindrical.

13. The system of claim 12, wherein the inner wall comprises a diameter ranging from 8 feet to 15 feet.

14. The system of claim 13, wherein the inner wall comprises a diameter ranging from 10 feet to 12 feet.

15. The system of claim 12, wherein the outer wall comprises a diameter that is up to four feet larger in diameter than the inner wall.

16. The system of claim 1, wherein the storage element is spherical.

17. The system of claim 16, wherein the inner wall comprises a diameter ranging from 30 feet to 40 feet.

18. The system of claim 17, wherein the outer wall comprises a diameter that is up to three feet larger in diameter than the inner wall.

19. The system of claim 1, wherein the insulating layer comprises perlite.

20. The system of claim 1, wherein the insulating layer is a vacuum.

21. The system of claim 1, wherein the lower cost is up to 50% less than comparable submarine pipeline costs or conventional LNG costs.

22. The method of claim 1, wherein the at least one storage module is located on land and then loaded on the floating vessel.

* * * * *

UNITED STATES PATENT AND TRADEMARK OFFICE

CERTIFICATE OF CORRECTION

PATENT NO. : 7,155,918 B1
APPLICATION NO. : 10/861969
DATED : January 2, 2007
INVENTOR(S) : Robert Magee Shivers, III It is certified that error appears in the above-identified patent and that said Letters Patent is hereby corrected as shown below:

Claim 3; Column 5, Line 44, please change “method” to --system--.

Claim 8; Column 6, Line 10, please change “method” to --system--.

Claim 9; Column 6, Line 12, please change “method” to --system--.

Claim 10; Column 6, Line 14, please change “method” to --system--.

Claim 11; Column 6, Line 16, please change “method” to --system--.

Claim 22; Column 6, Line 45, please change “method” to --system--.

Signed and Sealed this

Twelfth Day of June, 2007

JON W. DUDAS
*Director of the United States Patent and Trademark Office*